US007481000B2

(12) United States Patent
Tynes et al.

(10) Patent No.: US 7,481,000 B2
(45) Date of Patent: Jan. 27, 2009

(54) CHAINSAW BAR ADJUSTMENT ASSEMBLY WITH BREAKAWAY ADJUSTMENT PIN

(75) Inventors: Rodney W. Tynes, Shreveport, LA (US); Paul A. Warfel, Texarkana, TX (US); Dennis S. Zapanta, Wake Village, TX (US)

(73) Assignee: Husqvarna Outdoor Products Inc., Augusta, GA (US)

( * ) Notice: Subject to any disclaimer, the term of this patent is extended or adjusted under 35 U.S.C. 154(b) by 245 days.

(21) Appl. No.: 11/032,989

(22) Filed: Jan. 10, 2005

(65) Prior Publication Data

US 2006/0150427 A1 Jul. 13, 2006

(51) Int. Cl.
*B27B 17/14* (2006.01)

(52) U.S. Cl. ..... 30/386; 83/814

(58) Field of Classification Search ..... 30/386, 30/383, 385, 387; 83/814, 816; 474/101, 474/109, 111

See application file for complete search history.

(56) References Cited

U.S. PATENT DOCUMENTS

| | | | | |
|---|---|---|---|---|
| 2,645,254 | A * | 7/1953 | Ausdall | 30/379 |
| 3,194,284 | A | 7/1965 | Walker | |
| 4,026,020 | A | 5/1977 | Hoppner et al. | |
| 4,382,334 | A | 5/1983 | Reynolds | |
| 5,345,686 | A | 9/1994 | Zimmermann | |
| 5,497,557 | A * | 3/1996 | Martinsson | 30/386 |
| 5,528,835 | A | 6/1996 | Ra | |
| 6,560,879 | B2 | 5/2003 | Franke et al. | |
| 6,810,782 | B2 * | 11/2004 | Wuensch et al. | 83/699.21 |
| 2004/0148788 | A1 | 8/2004 | Behbahany | |

FOREIGN PATENT DOCUMENTS

| | | |
|---|---|---|
| EP | 1 637 299 A1 | 3/2006 |
| JP | 07-314402 | 12/1995 |
| WO | WO2004/103657 A1 | 12/2004 |

OTHER PUBLICATIONS

Office action issued from Canadian Patent Office dated Jan. 4, 2008; Serial No. 2,523,662.

* cited by examiner

*Primary Examiner*—Timothy V Eley
(74) *Attorney, Agent, or Firm*—Pearne & Gordon LLP

(57) ABSTRACT

A bar adjustment assembly for a chain saw includes a shaft, a bar adjustment pin that is journalled for rotation relative to the shaft, and a pin alignment spring that biases the pin toward an engagement position. A void is provided for accommodating the pin as it is rotated away from the engagement position by a guide bar that has been incorrectly attached.

23 Claims, 3 Drawing Sheets

FIG. 1
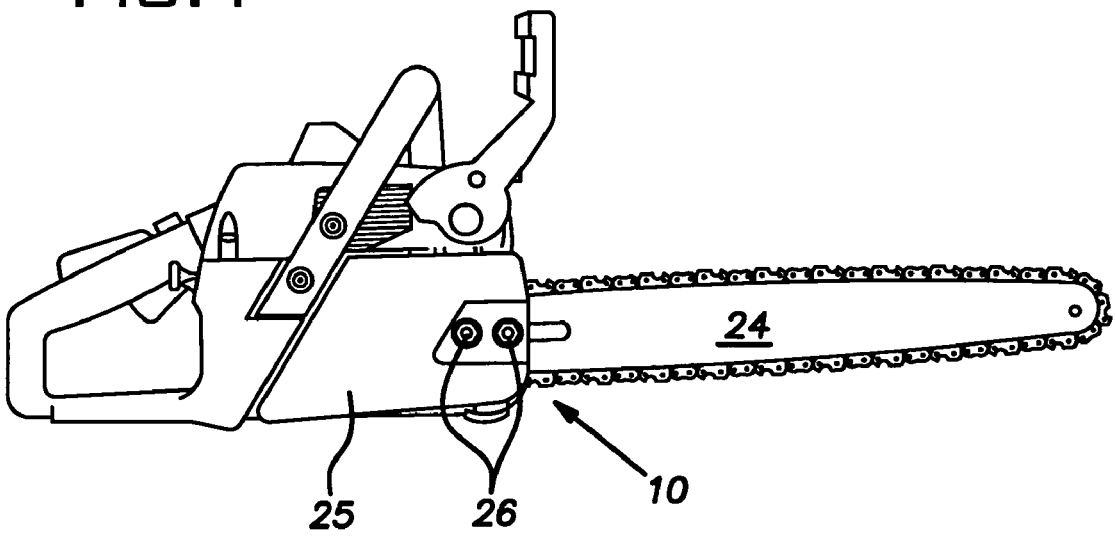
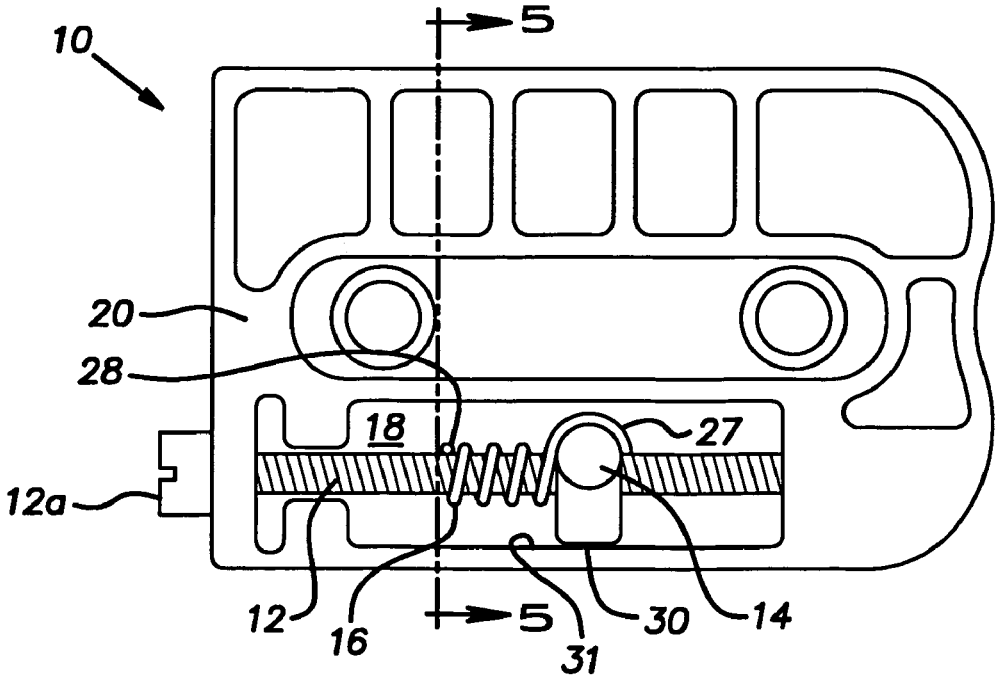
FIG. 2

CHAINSAW BAR ADJUSTMENT ASSEMBLY WITH BREAKAWAY ADJUSTMENT PIN

BACKGROUND OF THE INVENTION

The present invention relates to guide bar adjustment mechanisms for chainsaws, and more particularly to an adjustment mechanism having a breakaway adjustment pin.

Various mechanisms are known for adjusting the tension of the chain on a chainsaw. Nearly all of these mechanisms involve the movement of the guide bar upon which the chain rests. By lengthening the guide bar, the chain tension is increased. Conversely, shortening the guide bar decreases the chain tension.

A commonly used mechanism for adjusting the position of the guide bar consists of an adjustment pin threaded onto an adjustment screw provided on the body of the chainsaw. The adjustment pin engages a hole in the guide bar. As the adjustment screw is rotated, the pin advances or retreats along the screw, moving the guide bar with it.

One problem with these adjustment pin type chain tensioning mechanisms occurs during assembly of the guide bar onto the chainsaw body. The pin is not normally visible once the bar is placed onto the body. If the guide bar and the adjustment pin are not properly aligned during assembly, the adjustment pin and/or adjustment screw can be damaged.

BRIEF SUMMARY OF THE INVENTION

The present invention provides a bar adjustment assembly for a chainsaw including a self-aligning breakaway adjustment pin. The assembly comprises: a shaft, a bar adjustment pin journalled for rotation relative to the shaft, and a pin alignment spring biasing the rotation of the bar adjustment pin toward an engagement position.

According to a further aspect of the present invention, the assembly further comprises a void for accommodating the bar adjustment pin when the bar adjustment pin is rotated away from the engagement position.

BRIEF DESCRIPTION OF THE DRAWINGS

FIG. 1 is an overall view of a chainsaw having a guide bar adjustment mechanism according to the present invention;

FIG. 2 is a plan view of a portion of a chainsaw body that houses a guide bar adjustment mechanism according to the present invention;

DETAILED DESCRIPTION OF THE INVENTION

Figure 3:
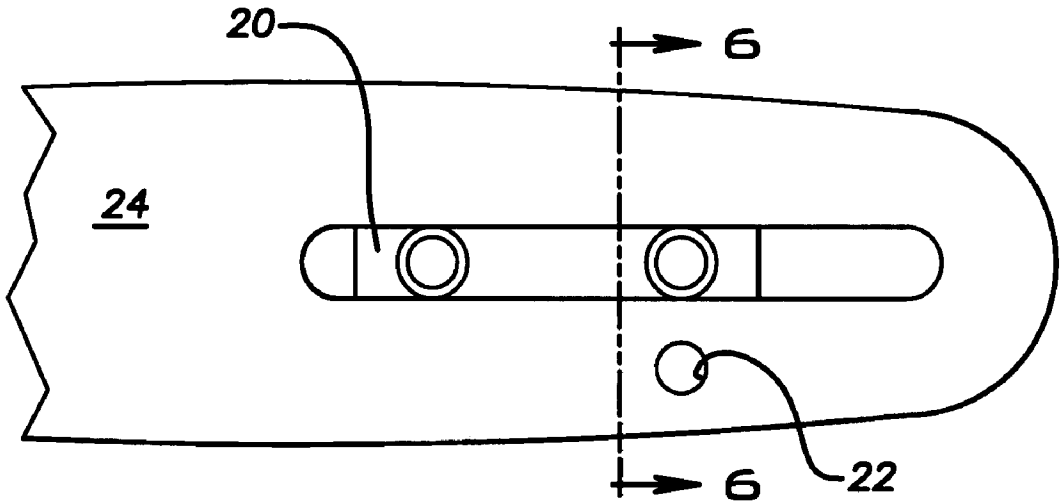
FIG. 3 is a plan view of the chainsaw body of FIG. 2 having a misaligned guide bar attached thereto.

As shown in FIGS. 1-7, a guide bar adjustment mechanism 10 for a chainsaw includes a threaded shaft or adjustment screw 12, an adjustment pin 14 and a pin alignment spring 16. The adjustment screw 12 is mounted within a void or recess 18 provided in a portion of a chainsaw body 20.

The adjustment pin 14 is journalled on the adjustment screw 12. Matching threads are provided on the adjustment pin 14 and the adjustment screw 12. When the adjustment screw 12 is rotated by using an appropriate tool on the head 12*a* of the adjustment screw 12, the adjustment pin 14 moves back and forth along the length of the adjustment screw 12. When the guide bar 24 is properly assembled onto the chainsaw body 20 (FIGS. 4 and 7), the adjustment pin 14 normally engages an adjustment hole or slot 22 in a guide bar 24. Due to the engagement of the adjustment hole 22 by the adjustment pin 14, as the adjustment pin 14 moves along the length of the adjustment screw 12, the guide bar 24 follows.

Figure 4:
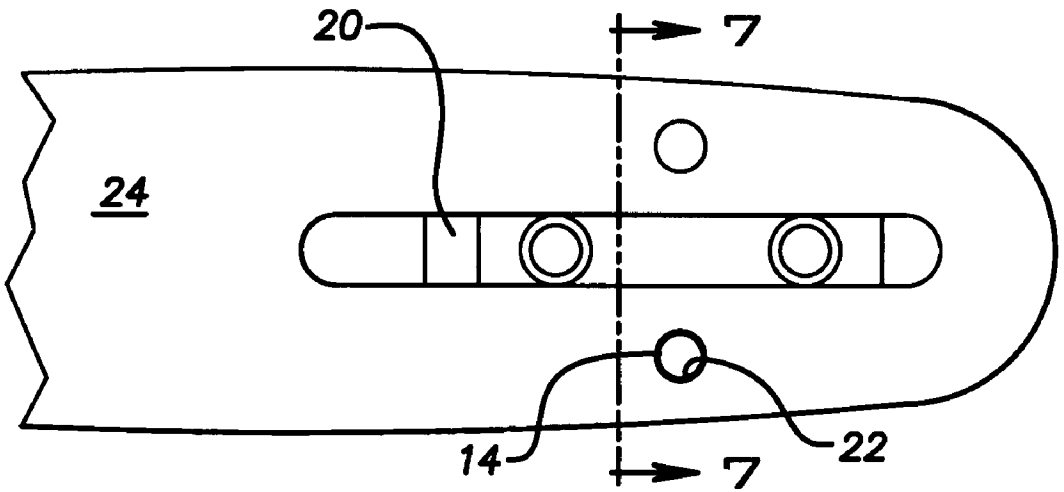
FIG. 4 is a plan view of the chainsaw body of FIG. 2 having a correctly aligned guide bar attached thereto.
Figure 7:
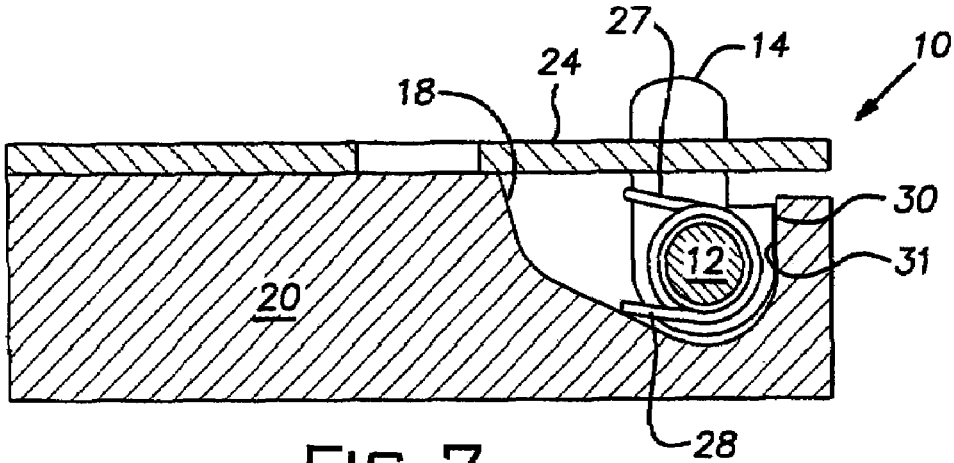
FIG. 7 is a cross section of the chainsaw body and guide bar adjustment mechanism taken along section line 7-7 of FIG. 4.

During assembly of the chainsaw, as illustrated in FIG. 4, the guide bar 24 is placed onto the chainsaw body 20 so that the adjustment pin protrudes through the adjustment hole 22 of the guide bar 24, as shown in FIGS. 4 and 7. Then, a cover portion 25 of the chainsaw is placed over the guide bar 24 and chainsaw body 20. The cover portion 25 is secured in place by two bolts 26 or other fasteners (see FIG. 1).

Figure 5:
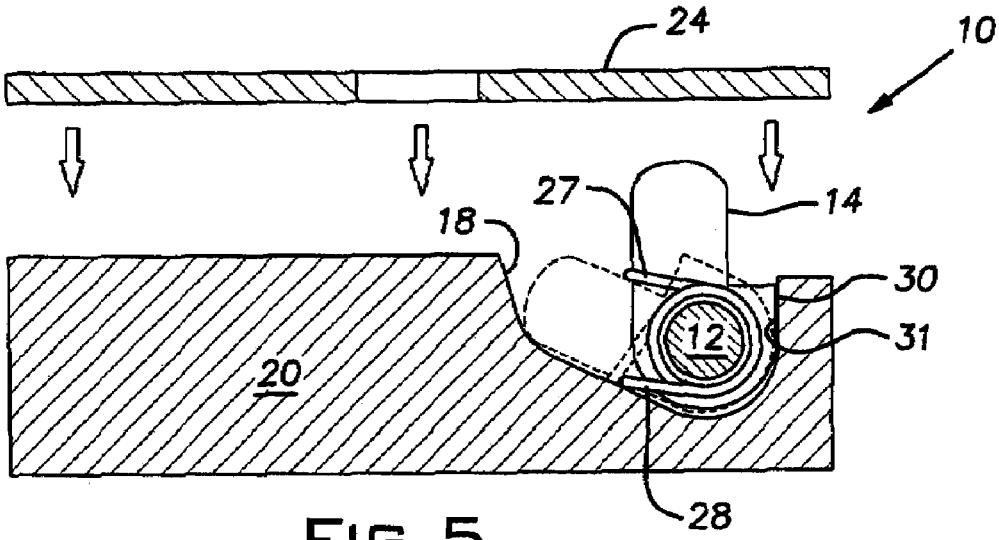
FIG. 5 is a cross section of the chainsaw body and guide bar adjustment mechanism taken along section line 5-5 of FIG. 2 showing the assembly direction of the guide bar.
Figure 6:
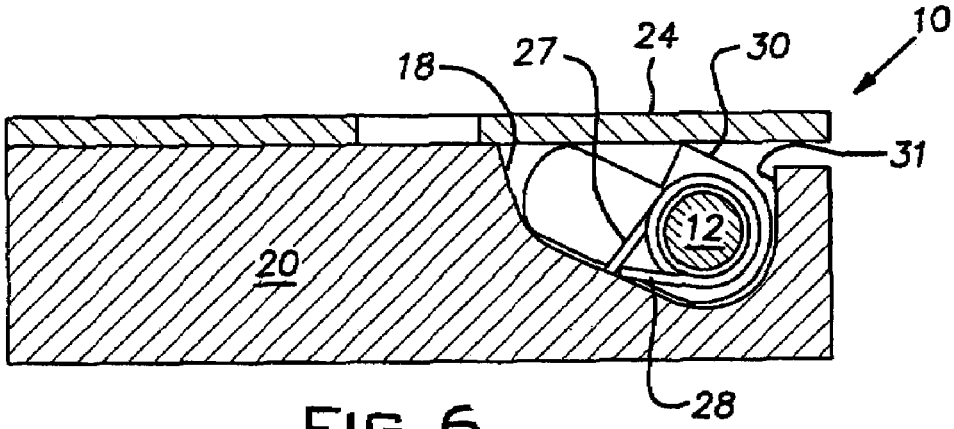
FIG. 6 is a cross section of the chainsaw body and guide bar adjustment mechanism taken along section line 6-6 of FIG. 3.

As shown by the broken lines in FIG. 5, the recess 18 is shaped to allow the guide pin 14 to pivot fully into the recess 18. Therefore, if the guide bar 24 is incorrectly positioned on the chainsaw body 20, such that the adjustment hole 22 is not aligned with the adjustment pin 14, the adjustment pin 14 can pivot out of the way, preventing damage to the adjustment mechanism 10 from occurring (FIGS. 3 and 6).

The pin alignment spring 16 is a helical torsion spring provided on the adjustment screw to keep the adjustment pin 14 in the correct orientation when the guide bar 24 is not attached. The pin alignment spring 16 is a helical torsion spring having first and second free ends (27, 28). The first end 27 of the pin alignment spring 16 engages the adjustment pin 14, and the second end of the pin alignment spring 16 engages a surface of the chainsaw body 20 within the recess 18. The pin alignment spring 16 is loosely wrapped on the adjustment screw 12, such that it is journalled thereon, to allow the pin alignment spring 16 to travel along the adjustment screw 12 with the adjustment pin 14. Alternatively, other types of springs, such as a helical tension spring, a helical compression spring, a spiral spring, a flat spring, etc., or other known types of biasing means such as elastic bands or straps, resilient foam or gel pads, etc., can be provided as the pin alignment means.

The pin alignment spring 16 is positioned to bias the pivoting of the adjustment pin 14 out of the recess 18. When the adjustment pin 14 is positioned fully upright in an engagement position, as shown in FIGS. 2, 5 and 7, a stop surface 30 meets a surface 31 of the chainsaw body 20 within the recess 18. This meeting of the two surfaces 30, 31 prevents the adjustment pin 14 from pivoting any further. Alternatively, other stop mechanisms could be used.

As described above, when the guide bar 24 is incorrectly positioned on the chainsaw body 20, the adjustment pin 14 pivots into the recess 18. When the guide bar 24 is subsequently removed from the chainsaw body 20, the alignment spring 16 causes the adjustment pin 14 to pivot to its fully upright position so that the guide bar 24, now being correctly aligned, can be reassembled without any manual repositioning of the adjustment pin 14.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A guide bar adjustment assembly for a chainsaw guide bar, the assembly comprising:

a shaft;

a bar adjustment pin journalled for rotation relative to the shaft and movement along the length of the shaft; and a pin alignment spring biasing the rotation of the bar adjustment pin toward an engagement position with the guide bar.

2. The guide bar adjustment assembly of claim 1, further comprising a void for accommodating the bar adjustment pin when the bar adjustment pin is rotated away from the engagement position.

3. The guide bar adjustment assembly of claim 1, further comprising a stop mechanism for preventing the pin alignment spring from rotating the bar adjustment pin past the engagement position.

4. The guide bar adjustment assembly of claim 1, wherein the pin alignment spring comprises an extension at an end of the pin alignment spring, the extension engaging the bar adjustment pin.

5. A guide bar adjustment assembly for a chainsaw, the assembly comprising:

a shaft a bar adjustment pin journalled for rotation relative to the shaft and movement along the length of the shaft; and a pin alignment spring biasing the rotation of the bar adjustment pin toward an engagement position, wherein the pin alignment spring is a helical torsion spring journalled on the shaft.

6. A guide bar adjustment assembly for adjusting the tension of a chain on a chainsaw guide bar by movement of the guide bar, the assembly comprising:

adjustment means for adjusting a position of the guide bar, the adjustment means comprising a moveable bar adjustment pin for engaging the guide bar at an engagement position; and alignment means for automatically aligning the bar adjustment pin into the engagement position.

7. the guide bar adjustment assembly of claim 6, further comprising means for accommodating the bar adjustment pin when the guide bar is misaligned with respect to the engagement position.

8. A guide bar adjustment assembly for adjusting the tension of a chain on a chainsaw guide bar by movement of the guide bar, the assembly comprising:

adjustment means for adjusting a position of the guide bar, the adjustment means comprising a moveable bar adjustment pin for engaging the guide bar at an engagement position; and alignment means for automatically aligning the bar adjustment pin into the engagement position, wherein the alignment means for automatically aligning the bar adjustment pin is a helical torsion spring.

9. A chainsaw comprising:

a chainsaw body;

a guide bar having an adjustment hole for slidably mounting onto the chainsaw body;

a bar adjustment shaft;

a bar adjustment pin journalled for rotation about the shaft; and a pin alignment spring biasing the rotation of the bar adjustment pin toward an engagement position for insertion into the adjustment hole of the guide bar when the guide bar is mounted on the chainsaw body.

10. The chainsaw of claim 9, wherein the chainsaw body comprises a void for accommodating the bar adjustment pin when the bar adjustment pin is rotated away from the engagement position.

11. The chainsaw of claim 9, wherein the pin alignment spring comprises an extension at an end of the pin alignment spring, the extension engaging the bar adjustment pin.

12. A chainsaw comprising:

a chainsaw body;

a guide bar having an adjustment hole for slidably mounting onto the chainsaw body;

a bar adjustment shaft;

a bar adjustment pin journalled for rotation about the shaft;

a pin alignment spring biasing the rotation of the bar adjustment pin toward an engagement position for insertion into the adjustment hole of the guide bar when the guide bar is mounted on the chainsaw body; and a stop mechanism for preventing the pin alignment spring from rotating the bar adjustment pin past the engagement position.

13. A chainsaw comprising:

a chainsaw body;

a guide bar having an adjustment hole for slidably mounting onto the chainsaw body;

a bar adjustment shaft;

a bar adjustment pin journalled for rotation about the shaft; and a pin alignment spring biasing the rotation of the bar adjustment pin toward an engagement position for insertion into the adjustment hole of the guide bar when the guide bar is mounted on the chainsaw body, the pin alignment spring comprising a helical torsion spring journalled on the shaft.

14. A guide bar adjustment assembly for a chainsaw, the assembly comprising:

a shaft having an outside thread;

a bar adjustment pin journalled for rotation relative to the shaft and threadably engaged with the shaft for translation along a longitudinal axis of the shaft upon rotation of the shaft; and a pin alignment spring biasing the rotation of the bar adjustment pin toward an engagement position.

15. The guide bar adjustment assembly of claim 14, further comprising a void for accommodating the bar adjustment pin when the bar adjustment pin is rotated away from the engagement position.

16. The guide bar adjustment assembly of claim 14, further comprising a stop mechanism for preventing the pin alignment spring from rotating the bar adjustment pin past the engagement position.

17. The guide bar adjustment assembly of claim 14, wherein the pin alignment spring is a helical torsion spring journalled on the shaft.

18. The guide bar adjustment assembly of claim 14, wherein the pin alignment spring comprises an extension at an end of the pin alignment spring, the extension engaging the bar adjustment pin.

19. A chainsaw comprising:

a chainsaw body;

a guide bar having an adjustment hole for slidably mounting onto the chainsaw body;

a bar adjustment shaft having an outside thread;

a bar adjustment pin journalled for rotation about the shaft and threadably engaged with the shaft for translation along a longitudinal axis of the shaft upon rotation of the shaft; and a pin alignment spring biasing the rotation of the bar adjustment pin toward an engagement position for insertion into the adjustment hole of the guide bar when the guide bar is mounted on the chainsaw body.

20. The chainsaw of claim 19, wherein the chainsaw body comprises a void for accommodating the bar adjustment pin when the bar adjustment pin is rotated away from the engagement position.

21. The chainsaw of claim 19, further comprising a stop mechanism for preventing the pin alignment spring from rotating the bar adjustment pin past the engagement position.

22. The chainsaw of claim 19, wherein the pin alignment spring is a helical torsion spring journalled on the shaft.

23. The chainsaw of claim 19, wherein the pin alignment spring comprises an extension at an end of the pin alignment spring, the extension engaging the bar adjustment pin.

* * * * *